US009605456B2

(12) United States Patent
Booker et al.

(10) Patent No.: US 9,605,456 B2
(45) Date of Patent: Mar. 28, 2017

(54) DOOR ASSISTANT

(71) Applicant: S & G GLOBAL SERVICES PTY LIMITED, Erina, NSW (AU)

(72) Inventors: Geoff Booker, Erina (AU); Sean Devine, Erina (AU); Michael Hort, Erina (AU)

(73) Assignee: S & G GLOBAL SERVICES PTY LIMITED, Erina (AU)

( * ) Notice: Subject to any disclaimer, the term of this patent is extended or adjusted under 35 U.S.C. 154(b) by 0 days.

(21) Appl. No.: 14/620,223

(22) Filed: Feb. 12, 2015

(65) Prior Publication Data

US 2015/0152674 A1 Jun. 4, 2015

Related U.S. Application Data

(63) Continuation of application No. 13/984,285, filed as application No. PCT/AU2012/000108 on Feb. 7, 2012.

(30) Foreign Application Priority Data

Feb. 8, 2011 (AU) ..... 2011200514

(51) Int. Cl.
*E05C 17/54* (2006.01)
*E05C 17/44* (2006.01)

(52) U.S. Cl.
CPC ..... *E05C 17/54* (2013.01); *E05C 17/44* (2013.01); *Y10T 292/73* (2015.04)

(58) Field of Classification Search
CPC ..... E05C 17/54; E05C 17/44; E05C 17/14; E05D 15/0652; E05D 15/0621; Y10T 292/73
USPC ..... 49/460; 16/408, 409; 292/343, 342, 288, 292/289, 338, 339, DIG. 15
See application file for complete search history.

(56) References Cited

U.S. PATENT DOCUMENTS 182,883 A 10/1876 Ball
353,536 A 11/1886 Burnley
(Continued)

FOREIGN PATENT DOCUMENTS

CH 619753 10/1980
CN 2285351 7/1998
(Continued)

*Primary Examiner* — Katherine Mitchell
*Assistant Examiner* — Marcus Menezes
(74) *Attorney, Agent, or Firm* — Mark M. Friedman

(57) ABSTRACT

A door assistant includes a generally wedge-shaped portion and a handle. The wedge-shaped portion includes a surface defined between a first lower end and a second higher end. The handle includes a generally vertically extending portion and a grasping portion. The handle operates between a first orientation in which the grasping portion is aligned with the wedge shaped portion, and a second orientation in which the grasping portion is aligned with a surface of a door when the door assistant is in use. The handle places the wedge-shaped portion in a desired position relative to a lower edge of a door by a user. The door assistant further includes a foot pad extending rearwardly from the wedge-shaped portion, and has a surface sloping downward from the second higher end to the first lower end.

17 Claims, 11 Drawing Sheets

(56) References Cited

U.S. PATENT DOCUMENTS

| | | | | | |
|---|---|---|---|---|---|
| 550,264 | A * | 11/1895 | Flesch | E05C 17/54 | 292/343 |
| 1,654,958 | A * | 1/1928 | Breton | B25G 1/06 | 294/57 |
| 1,693,158 | A | 11/1928 | Reinicke et al. | | |
| 2,376,117 | A | 5/1945 | Bright et al. | | |
| 2,647,782 | A * | 8/1953 | Fisk | E05C 17/54 | 292/288 |
| 2,756,527 | A | 7/1956 | Mease | | |
| 2,766,527 | A | 10/1956 | Vines et al. | | |
| 3,143,369 | A | 8/1964 | Adams | | |
| 3,195,880 | A * | 7/1965 | Ritchey | E05B 17/0033 | 292/251.5 |
| 3,328,065 | A * | 6/1967 | Arenson | E05C 17/54 | 16/86 A |
| D219,362 | S * | 12/1970 | Snyder | D8/339 | |
| 4,142,752 | A * | 3/1979 | Chilton | E05C 17/54 | 16/82 |
| 4,542,667 | A * | 9/1985 | Jang | B25G 1/005 | 81/177.2 |
| 4,607,870 | A * | 8/1986 | Crisp et al. | 292/338 | |
| 5,038,870 | A * | 8/1991 | Kuronen | A01K 97/01 | 175/18 |
| 5,064,232 | A * | 11/1991 | Quarberg | 292/339 | |
| 5,217,269 | A * | 6/1993 | Wiltberger | E05C 17/54 | 292/343 |
| 5,676,410 | A | 10/1997 | Angerbrandt | | |
| 5,771,910 | A * | 6/1998 | Kluttz | A61H 3/02 | 135/68 |
| 6,301,746 | B1 * | 10/2001 | Myers | A45C 13/22 | 16/113.1 |
| 6,557,915 | B1 * | 5/2003 | Duff | E05C 17/54 | 292/343 |
| 7,261,344 | B1 | 8/2007 | Drake, Jr. | | |
| 7,506,905 | B1 | 3/2009 | George | | |
| 7,832,532 | B2 * | 11/2010 | Nykoluk | A45C 13/262 | 16/113.1 |
| 7,976,080 | B1 * | 7/2011 | Duff | E05C 17/54 | 292/251.5 |
| 2002/0180221 | A1 * | 12/2002 | Flowers | 292/339 | |
| 2004/0256866 | A1 | 12/2004 | Deming, Jr. | | |
| 2009/0183316 | A1 * | 7/2009 | McGovern | A01B 1/022 | 7/116 |
| 2010/0289280 | A1 | 11/2010 | Nadrowaski | | |

FOREIGN PATENT DOCUMENTS

| | | | | |
|---|---|---|---|---|
| CN | 201246045 | | 7/1998 | |
| CN | 201406919 | | 2/2010 | |
| DE | 29901541 | U | 8/1999 | |
| GB | 309682 | | 4/1929 | |
| GB | 2279108 | | 12/1994 | |
| GB | 2478366 | | 9/2011 | |
| GB | 2478366 | B * | 8/2014 | |
| JP | H0170966 | U | 5/1989 | |
| JP | H0431982 | U | 2/1992 | |
| JP | H0472170 | U | 6/1992 | |
| WO | WO 2008129721 | A1 * | 10/2008 | E05C 17/54 |

* cited by examiner

DOOR ASSISTANT

The present invention relates to door furniture and, more particularly, to apparatus for control of an unlatched, loose swinging door.

It is common to prevent the unwanted closures of an unlatched, open door by placing some suitably heavy object against the door when this has been opened to its maximum extent, so that the door is retained between the object and, typically, an adjacent wall.

It is also known to wedge a door in its open or partly position, by the introduction of a suitable wedge shaped object between the underside of the door and the floor, and many forms of wedges have been devised and are available for this purpose. These wedges, generally being small objects, are often misplaced and not readily to hand when a door needs to be secured in an open or partly open position.

A problem, particularly for elderly or physically impaired people, lies in the use of both these methods of controlling an open door. In each case bending to floor or near floor level is required, which, even for non-disabled people or younger people, can be an onerous task, especially where a heavy door may be under wind load and difficult to control.

Another problem can occur with heavy doors which are provided with automatic closing devices. Such doors can be difficult to secure with the typical wedges that are commercially available.

It is an object of the present invention to address or at least ameliorate some of the above disadvantages.

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

SUMMARY OF INVENTION

Accordingly, in a first broad form of the invention, there is provided a door assistant apparatus for retaining an opened door in a desired position; said door assistant comprising a wedge-shaped portion, a foot pad portion and a vertically extending handle portion; said handle portion including a grasping portion rotatably mounted to a vertical element of said handle portion; said grasping portion operable between a first position substantially aligned with said wedge-shaped portion and said foot pad portion, and a second position wherein said grasping portion is substantially aligned with a surface of a door to which said door assistant has been applied.

Preferably, said wedge-shaped portion comprises an elongate, generally rectangular prismatic body; said body tapering upwardly from a first distal lower end to a second proximate higher end.

Preferably, heights above a supporting floor surface at said first distal lower end and at said second proximate higher end are such as to define a surface between said ends able to provide friction contact with an edge of an underside of a door.

Preferably, said foot pad extends rearwardly from said second proximate higher end; said foot pad presenting a generally downward sloping surface; said downward sloping surface extending from a height approximately equal to height of said second proximate end of said wedge-shaped portion to a lower end.

Preferably, said foot pad is of greater width than width of said wedge-shaped portion.

Preferably, said wedge-shaped portion and said foot pad portion are hingedly connected to central base block; rotation of said wedge-shaped portion and said foot pad portion adapted to substantially align said wedge-shaped portion and said foot pad portion with said vertically extending handle portion for packaging and transport of said door assistant.

Preferably, said vertically extending handle portion includes a rigid vertical tubular element; said rigid vertical element extending upwardly from said central base block.

Preferably, said vertically extending handle portion further includes a grasping element; said grasping element comprising a shaft element coaxial with an axis of said rigid vertical tubular element and a grip element extending substantially normal to said shaft portion.

Preferably, said grasping element is rotatably mounted to said rigid vertical tubular element with a release mechanism; said release mechanism operated by a bushbutton located at an upper end of said shaft portion.

Preferably, said rigid vertical tubular element is provided with outrigger elements; said outrigger elements supporting a pair of shell elements; said shell elements when assembled forming a smooth tapering, rounded enclosure extending from the upper end of said central base block to proximate said grasping portion.

In another broad form of the invention, there is provided a method of securing an open door in a desired open position; said method including the steps of a user:

(a) grasping a handle portion of a door assistant so as to position a wedge-shaped portion of said door assistant proximate a lower edge of said open door, (b) driving a sloping surface of said wedge-shaped portion under said lower edge of said open door by application of the foot of said user;

(c) rotating said grasping portion such that said grasping portion is aligned with a surface of said open door when said door assistant is positioned for use, said positioning being such that said wedge-shaped portion is in friction contact with a supporting floor surface below said lower edge of said door and with said lower edge; said wedge-shaped portion including a surface defined between a first distal lower end and a second proximate higher end, and wherein said door assistant further includes a foot pad extending rearwardly from said wedge-shaped portion; a surface of said foot pad having a downward sloping surface from said second proximate higher end.

In another broad form of the invention there is provided a security device for arresting a partly opened door in a partially opened position; said device comprising a wedge-shaped portion, a rearwardly extending sloping foot pad portion and a substantially vertically extending handle portion; said handle portion including a rotatably mounted grasping portion; said grasping portion operable between a first position substantially aligned with said wedge-shaped portion and said rearwardly extending sloping foot pad portion, and a second position wherein said grasping portion is substantially aligned with a surface of said door.

In yet another broad form of the invention there is provided a method of operating a security device for arresting a partly open door; said method including the steps of:

(a) grasping a grasping portion of a handle portion of a door assistant apparatus, (b) placing said door assistant apparatus adjacent said door with a wedge-shaped portion of said apparatus proximate a lower edge of said door, (c) placing a user's foot on a sloping rear foot portion of said security device, (d) allowing said door to open against said wedge-shaped portion.

BRIEF DESCRIPTION OF DRAWINGS

Embodiments of the present invention will now be described with reference to the accompanying drawings wherein.

DESCRIPTION OF EMBODIMENTS

First Preferred Embodiment

Figure 1:
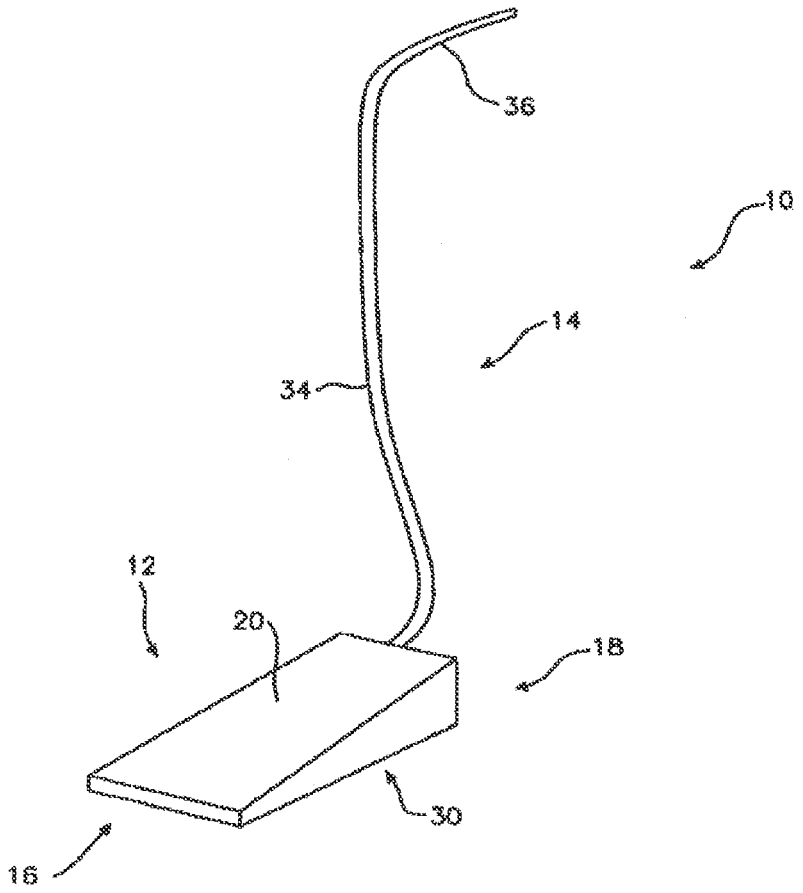
FIG. 1 is a perspective view of a first preferred embodiment of a door assistant according to the invention.
Figure 2:
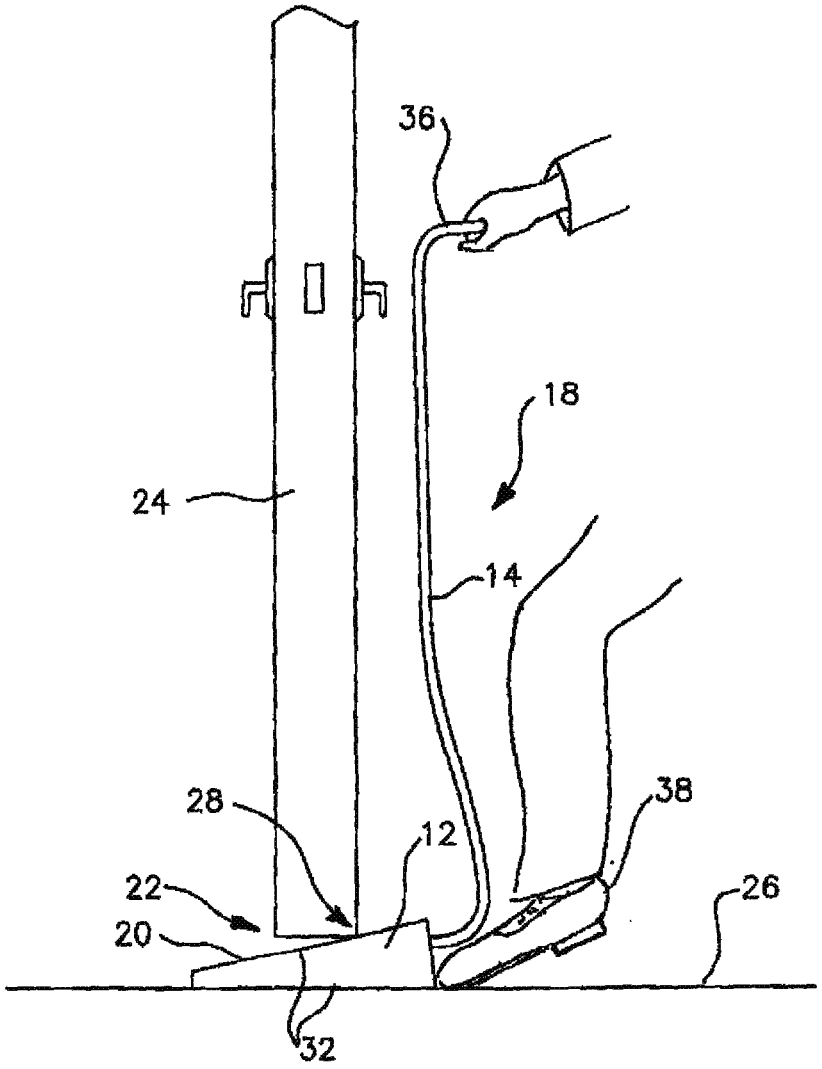
FIG. 2 is a side view of the lower portion of a door wedged in an open position by the door assistant of FIG. 1.

With reference to FIGS. 1 and 2, in a first preferred embodiment of the invention, a door assistant 10 comprises a wedged-shaped portion 12 and an upwardly extending handle 14. The wedge-shaped portion 12 is conventionally shaped, formed as a generally rectangular prismatic body tapering up from a first distal lower end 16 to a second higher proximate end 18.

Extending between this first end 16 and second end 18 is thus a sloping surface 20 which, when the wedge-shaped portion 12 is driven into position under the lower end 22 of a door 24, assures the position of the door assistant by friction contact between the supporting floor surface 26 and the outer lower edge 28 of the door 24.

The wedge-shaped portion 12 may be formed of any suitable material, either rigid or semi rigid. Preferably at least the sloping surface 20 and the underside 30 may be provided with a laminated layer of high friction polymeric material 32, so as to more securely retain the wedge-shaped portion 12 in a desired door holding position.

The handle 14 in this embodiment, comprises a generally vertically extending portion 34 and a laterally extending grasping portion 36, by means of which the door assistant can be readily lifted and moved by a user to any desired position without having to bend down. Preferably, in this embodiment the vertically extending portion 34 and the grasping portion 36 are formed from a single length of malleable rod.

To position the door assistant for use in securing an open door, the wedge-shaped portion 12 is brought to a position adjacent the outer lower edge 28 of the door 24. The wedge-shaped portion 12 may then be driven into the wedging position by the application of a user's foot 38 pushing against the rear of the wedge-shaped portion 12, with either the door 24 being arrested by an adjacent wall, door stop, or held in position with the user's other hand, until the door assistant is in a wedged position.

Second Preferred Embodiment

Figure 3:
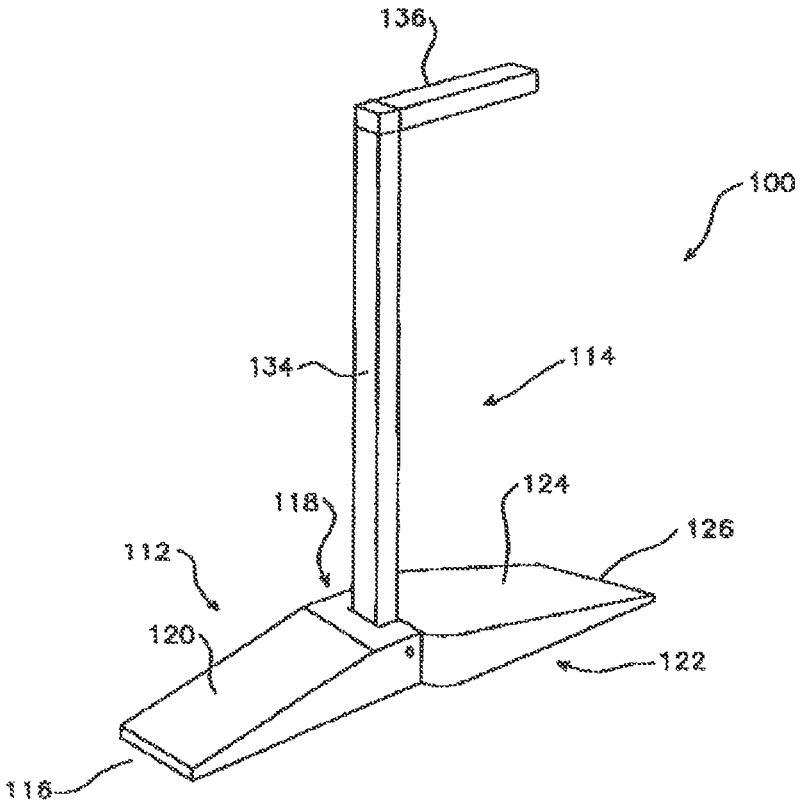
FIG. 3 is a perspective view of a second preferred embodiment of a door assistant according to the invention.

In a second preferred embodiment of a door assistant according to the invention and with reference now to FIG. 3, a door assistant 100 again comprises a wedge-shaped portion 112 and a vertically extending handle 114. As before the wedge-shaped portion 112 includes a sloping surface 120 extending between a first distal lower end 116 and rising to a second proximate higher end 118. In this case, however, a foot pad 122 extends rearwardly from the higher proximate end 118, presenting a generally downward sloping surface 124. This downward sloping surface extends from a height approximately equal to the height of the second end 118 of the wedge-shaped portion 112 to a lower end 126.

The foot pad 122 may be significantly wider than the wedge-shaped portion 112 and provides a surface against which the foot of a user may be placed to slide the wedge-shaped portion 112 into a wedged position under the lower edge of an open door. Preferably, the underside of the foot pad is provided with a high friction material so that, once in position, it augments the resistance to dislodgement from a desired position of the wedged portion 112. The wider foot pad portion 122 further provides for greater stability of the door assistant 100 when not in use.

Preferably in this embodiment, the vertically extending portion 134 and laterally extending grasping portion 136 of the handle 114, are formed from tubular sections, connected together.

Figure 4A:
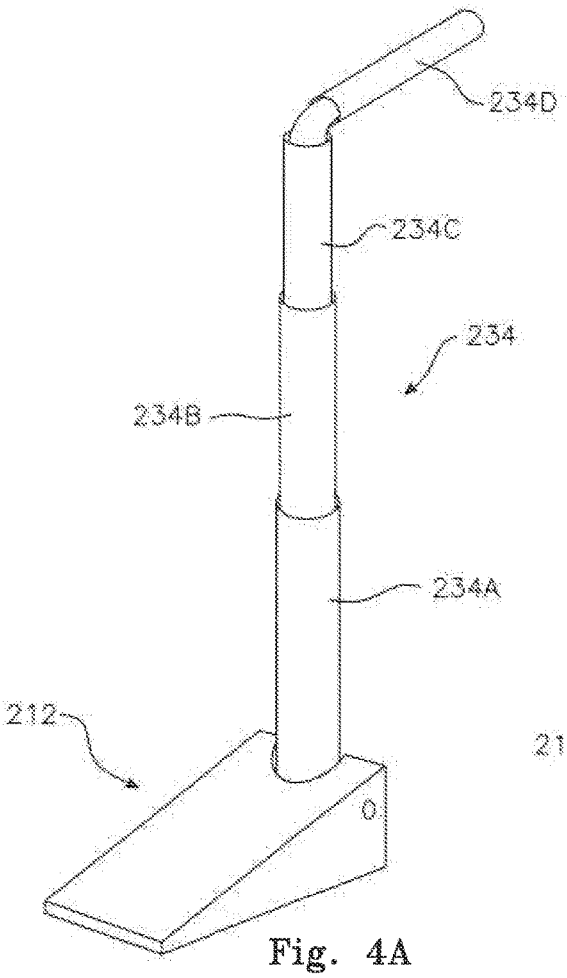
FIGS. 4A and 4B are perspective views of a further embodiment of a door assistant shown respectively in an in use and in a collapsed condition.
Figure 4C:
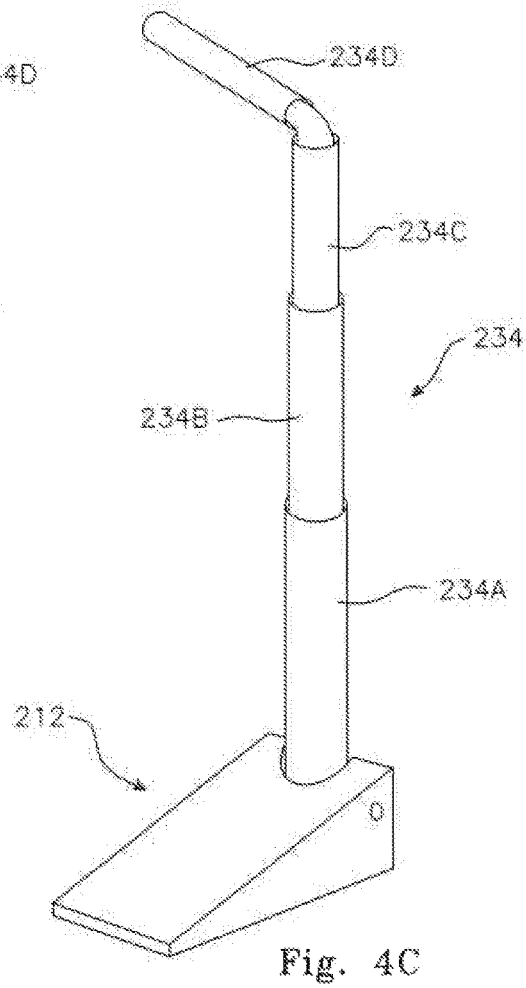
FIG. 4C is a further perspective view showing a second orientation of a grasping portion of the door assistant.
Figure 4B:
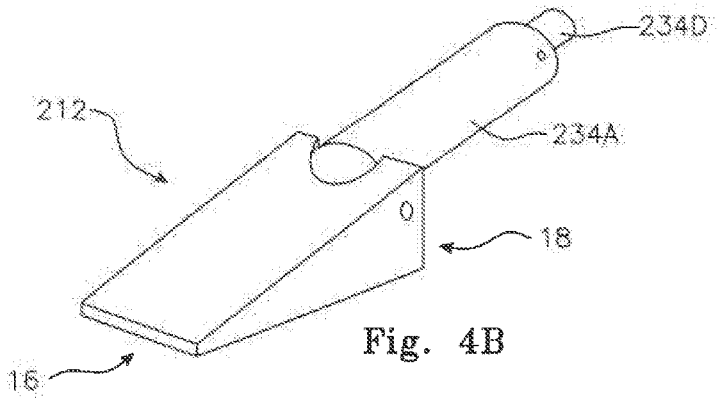

Alternatively, for either embodiment, and as shown in FIGS. 4A and 4B, the vertically extending portion 234 and the grasping portion 236 may be formed of a number of tabular sections 234A to 234B of decreasing diameters so as to be telescopically assembled. In this arrangement, the handle 214 may be collapsed into a first tubular section 234A adjacent the wedge-shaped portion 212 and of a length similar to that of the wedge-shaped portion. Preferably this first tubular section 234A is rotatably attached to the wedge-shaped portion so that the two may be rotated into alignment for packaging, transport or storage.

In both the above described embodiments, the handles 14/114/214 may be located in sockets provided in the wedge-shaped portions 12/112/212. In at least one preferred arrangement, the handle is releasably retained in its socket so as to be removable for storage.

Again preferably, in another arrangement, the handle may be rotated in the socket such that the grasping portion can be generally aligned with the surface of the door, thereby minimising obstruction to passage past the door. Alternatively, the grasping portion of the handle may be attached to the upright portion by a connection which allows the handle to be folded down alongside the upright portion.

In still a further preferred arrangement, both the wedge shaped portion and the rearwardly projecting foot pad portion 122 of the second embodiment of the door assistant 100, may be hingedly attached to the upright portion 134 of the handle 114, so as to allow their rotation into an aligned position relative the handle for packaging and storage. In this case the rotation may be controlled by a looking pin so that for use, the wedge shaped portion 112 and foot pad 120 are locked into position at right angles to the upright portion of the handle.

Third Preferred Embodiment

Figure 5:
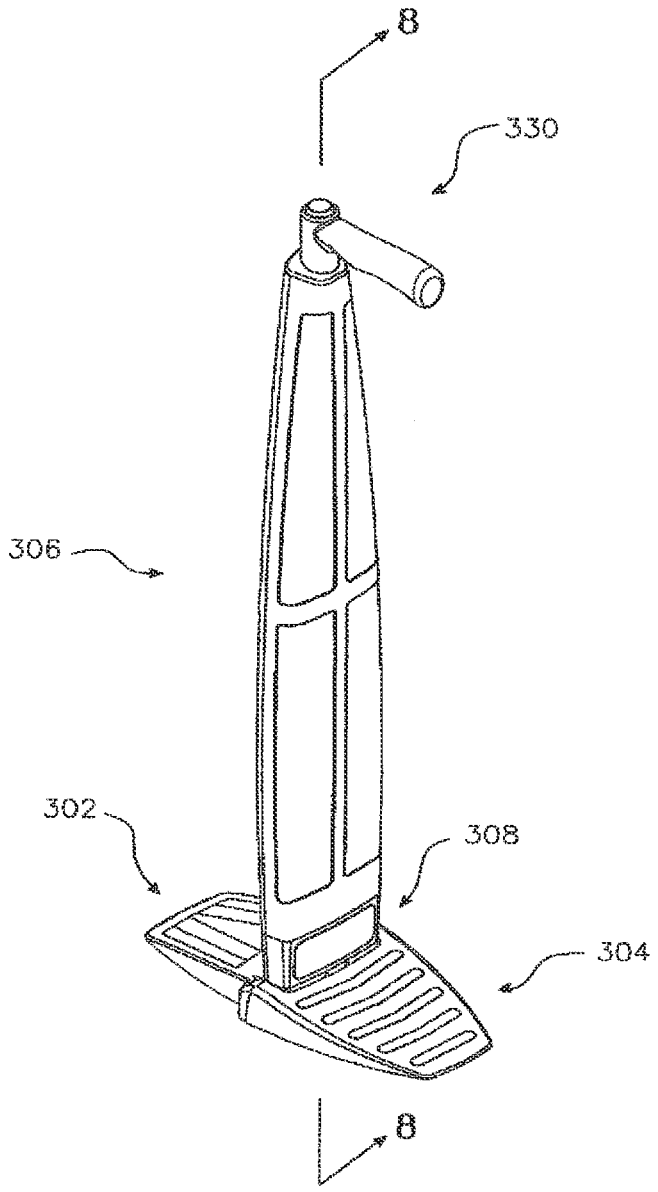
FIG. 5 is a perspective view of a door assistant according to a further preferred embodiment of the invention.

With reference now to FIG. 5, a door assistant 300 according to this embodiment, again includes a forwardly extending wedge shaped portion 302, a rearwardly extending foot pad portion 304 and a vertically extending handle portion 306. Each of the wedge shaped portion 302 and the foot pad portion 304 are hingedly attached to a central base block 308 as best seen in the enlarge view of FIG. 10. Preferably, base block 308 is of a relatively dense material, for example cast iron, while the wedge shaped portion 302 and the foot portion 304 are preferably of a polymer material.

Figure 10:
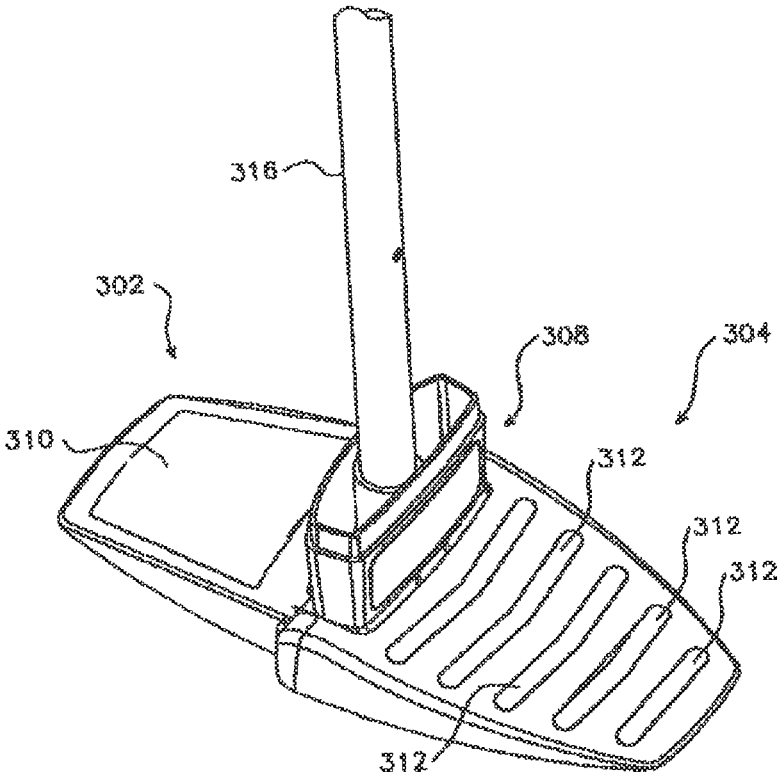
FIG. 10 is an enlarged perspective view of the lower end of the door assistant with cover elements removed.

The undersides of both wedge shaped portion 302 and foot pad portion 304, are preferably provided with a layer of a high friction polymer material (not shown). Likewise the upper surfaces of both the wedge portion 302 and the foot pad portion 304 may be provided with high friction inserts 310 and 312 respectively, again as best seen in FIG. 10.

Figure 7:
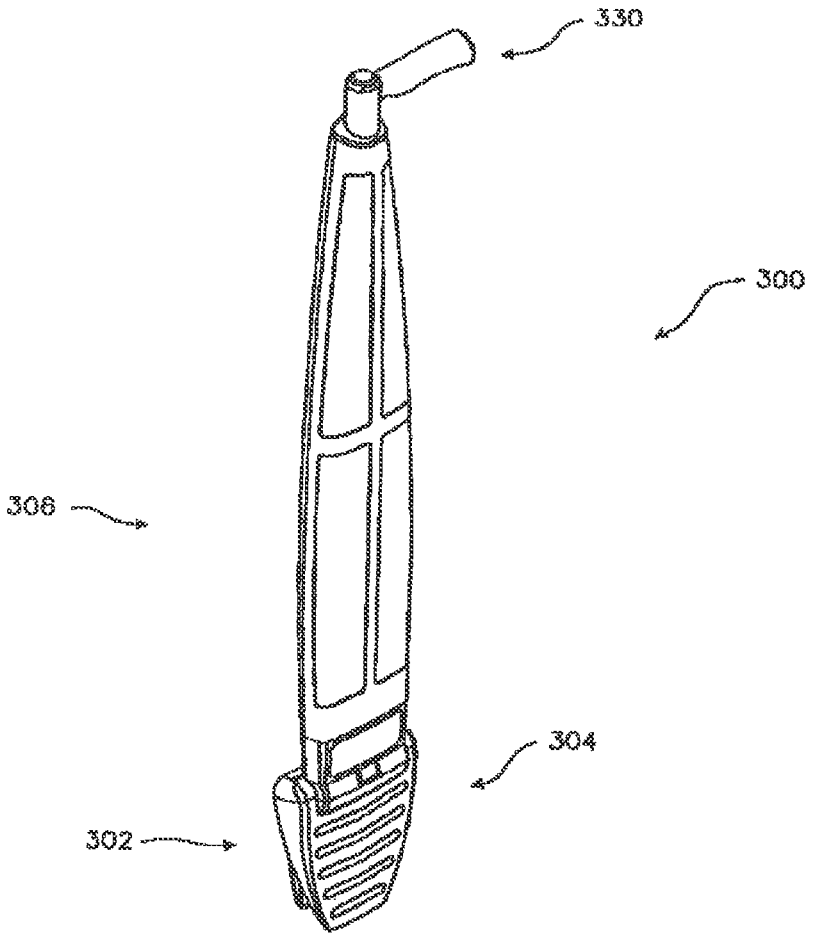
FIG. 7 is a side view of the door assistant of FIGS. 5 and 6 configured for packaging and transport.
Figure 11:
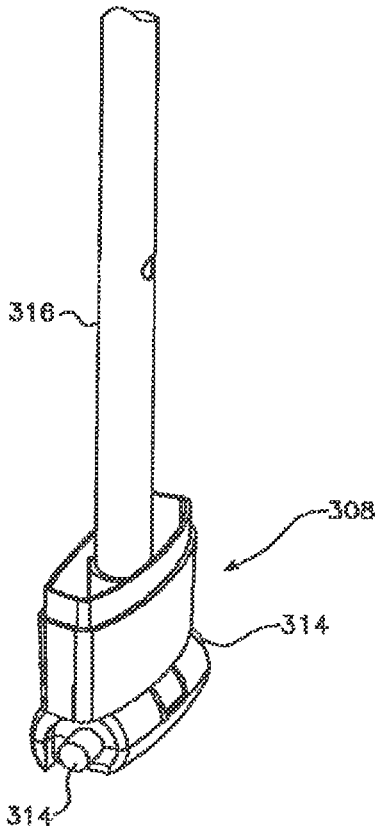
FIG. 11 is an enlarged view of the lower end of FIG. 10 with the wedge-shaped and foot pad portions removed.

Hinge pins 314 extend from either side of the base block 308 (see FIG. 11) and connect with respective extension portions of the wedge shaped portion 302 and the foot pad portion 304. This hinged arrangement of the wedge shaped portion 302 and the foot pad portion 304 allows these to be folded downwardly and towards each other relative the base block 308, as seen in FIG. 7 so as to assume a position substantially aligned with the vertically extending handle portion 306. This position of the wedge shaped portion 302 and foot pad portion 304 in advantageous for the purposes of packaging and transporting the door assistant 300 prior to purchase and use by a user.

Figure 6:
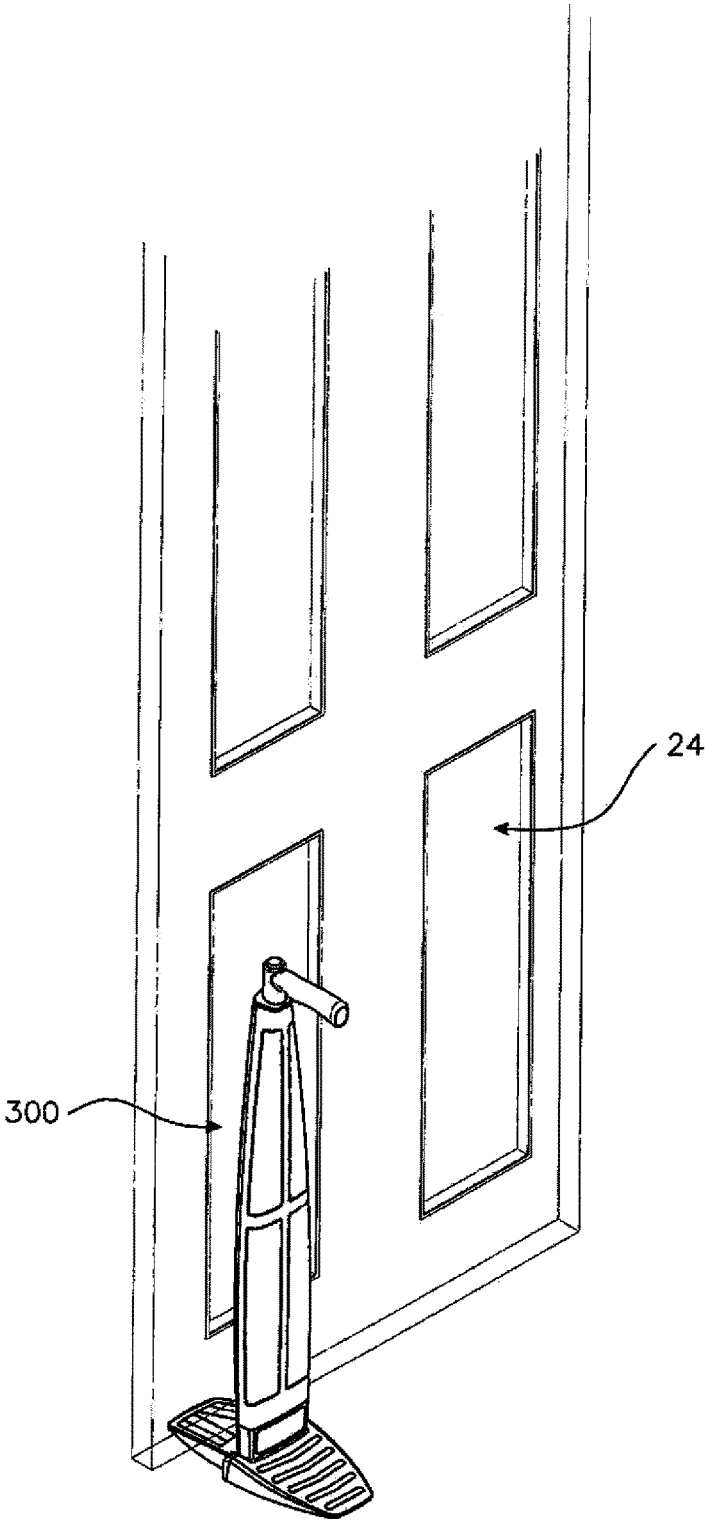
FIG. 6 is a perspective view of a door with the door assistant of FIG. 5 positioned for use.

The extension portions of the wedge shaped portion 302 and the foot pad portion 304 which connect these elements with the base block 308, are provided with engagement elements, for example detent lugs (not shown) such that when the wedge shaped portion 302 and the foot pad portion 304 are swung into their in-use positions shown in FIGS. 5 and 6, they snap into corresponding engagement elements on the base block so as to lock then into this in-use position.

Figure 8:
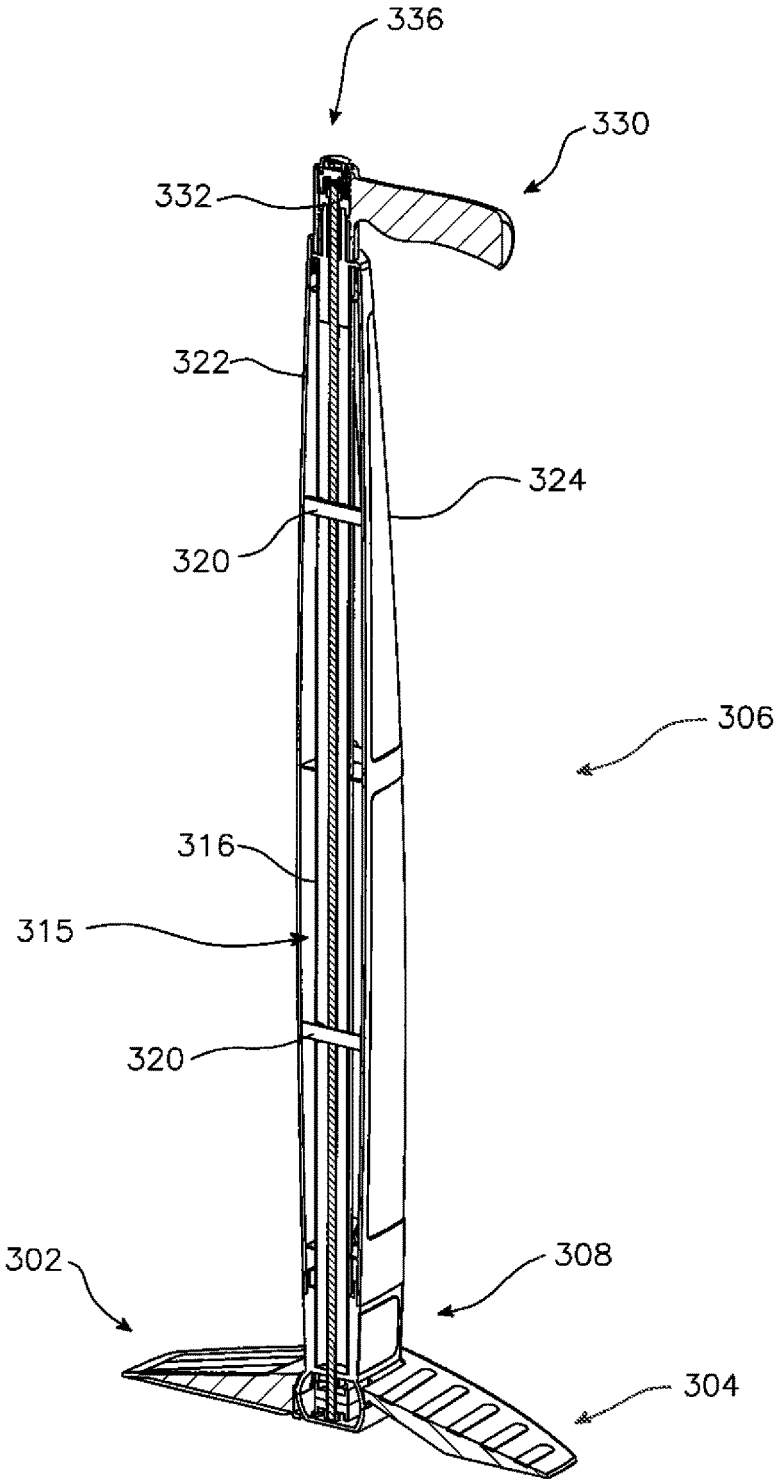
FIG. 8 is a sectioned view of the door assistant of FIGS. 5 to 7.
Figure 9:
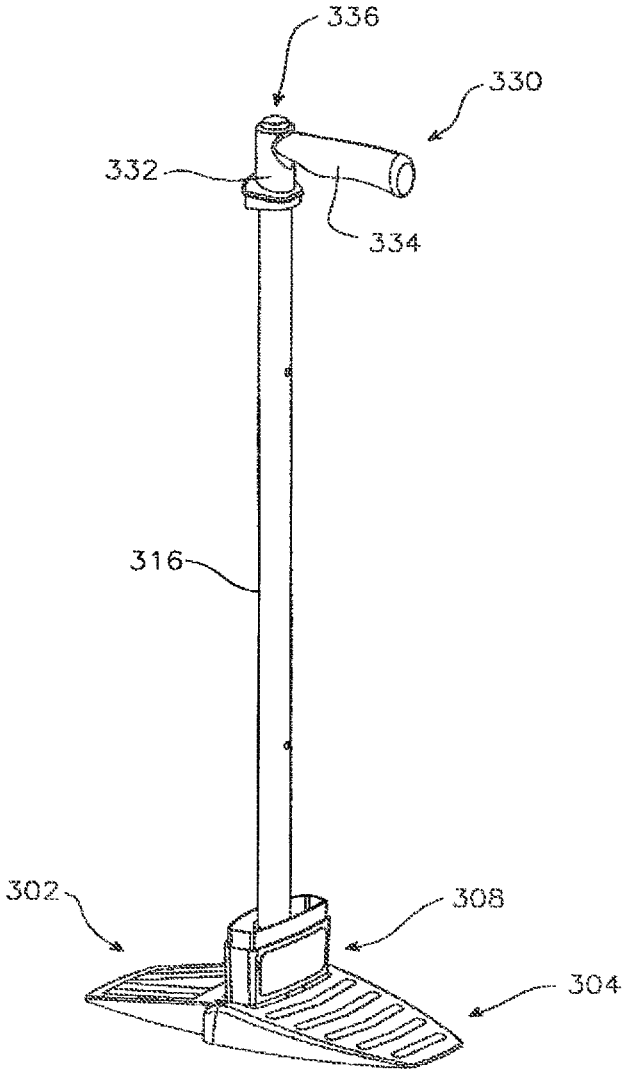
FIG. 9 is a perspective view of the internal structure of the door assistant of FIGS. 5 to 8.

With reference now to FIGS. 8 and 9, a rigid vertical element 316 of the handle portion 306 extends upwardly from the central base block 308. Preferably this vertical element is a metal tubular element 316 as best seen in the sectioned view of FIG. 8. Tubular element 316 is rigidly attached to base block 308 and is provided with a number of outrigger elements 320 adapted for support of two polymer shell elements 322 and 324 which assemble around the support structure of the tubular element 316 and outrigger elements 320. When assembled, the shell elements form a smooth tapering, rounded enclosure, as shown in FIGS. 5 to 7, extending from the upper end of the central base block 308 to proximate a grasping portion 330 provided at the upper end of the tubular element 316.

Grasping element 330 comprises a shaft portion 332 coaxial with the tubular element 316, and a grip portion 334 which attends from the shaft portion 332 substantially normal to the axis of the shaft portion. Shaft portion 332 is rotationally mounted to the tubular element 316. A pushbutton 336 is provided at the upper end of the shaft portion, which operates a detent release mechanism (not shown) provided in the upper end of the tubular element 316. When released, the grasping portion is able to be rotated at 90 degrees in either a clockwise or anticlockwise direction from its position aligned with the wedge-shaped portion 302 and foot pad portion 304.

By means of this release mechanism, the grasping portion 330 of the handle 306 is operable between a first position in which the grip portion 334 is substantially aligned with the wedge shaped portion 302 and foot pad portion 304 as shown in FIG. 5, and a second position in which the grip portion 334 may be aligned with the surface of a door to which the door assistant has been applied. The grip portion 334 is initially placed into this latter position prior to purchase and use, when the door assist is in the packaging/transport configuration as shown in FIG. 7.

INDUSTRIAL APPLICABILITY

The present invention greatly enhances the operation of wedging a door into a desired position. The door assist of the invention can be "parked" in a readily accessible position near the door, or in a nearby cupboard for example, when not in use. It can then be conveniently grasped by its handle, positioned near the lower door edge and pushed into the wedging position, all without any bending down being required of the user. Especially for elderly, disabled or incapacitated users, the placement of a conventional wedge can be very difficult if not, for some, impossible.

The wedge-shaped portion and the foot pad portion, provide a well-supported base, allowing the door assistant of the invention to be placed in any convenient position ready for use. The handle and its grasping portion allow the device to be easily lifted and placed into a desired position, either to hold a door in its opened position or arrest a door in a partly opened position for security reasons.

In a security situation, by placing the door assist adjacent a door prior to opening it, the door is easily prevented from opening further than the placed position of the door assistant. Thus it provides a secure way of partially opening a door. If extra retention force is required, the foot pad portion provides for the placement of a user's foot to increase the downward force on the pad and so increase the resistance to movement of the door assistant.

The above describes only some embodiments of the present invention and modifications, obvious to those skilled in the art, can be made thereto without departing from the scope of the present invention.

The invention claimed is:

1. A door assistant; said door assistant comprising:

(i) a generally wedge-shaped wedge portion;

(ii) a handle;

(iii) a wedge-shaped foot pad, wherein said wedge-shaped foot pad is separate from the wedge-shaped wedge portion, and wherein, in use, said a wedge-shaped foot pad extends rearwardly from said wedge-shaped wedge portion; and (iv) a central base block;

wherein said wedge-shaped wedge portion including a surface defined between a first leading lower end and a second higher end of said wedge-shaped wedge portion;

said handle including a generally vertically extending portion and a grasping portion extending laterally substantially normal from said vertically extending portion;

said grasping portion rotatable about said vertically extending portion relative to said wedged-shaped wedge portion between a first orientation wherein said grasping portion is aligned with said wedge-shaped wedge portion, and a second orientation wherein said grasping portion is aligned with a surface of a door when said door assistant is in position for use;

said handle adapted for placement of said wedge-shaped wedge portion in a desired position relative to a lower edge of said door by a user;

said wedge-shaped foot pad having a generally wedge-shape and including a downward sloping surface defined between a first higher end and a second trailing lower end of said wedge-shaped foot pad; and said wedge-shaped wedge portion and said wedge-shaped foot pad are hingedly connected to said central base block.

2. The door assistant of claim 1 wherein said grasping portion extends laterally from an upper end of said vertically extending portion when said door assistant is grasped for manipulation when in use.

3. The door assistant of claim 1 wherein said wedge-shaped wedge portion comprises an elongate, generally rectangular prismatic body; said body tapering so as to decrease in height from said second higher end to said first leading lower end.

4. The door assistant of claim 3 wherein an upper surface of said generally rectangular body extends from a first height above a supporting floor surface at said first leading lower end of said generally wedge-shaped wedge portion to a second height above said supporting floor surface at said second higher end of said generally wedge-shaped wedge portion; said upper surface providing friction contact with said lower edge of said door.

5. The door assistant of claim 3 wherein said handle extends upwardly from proximate said second higher end of said generally wedge-shaped wedge portion.

6. The door assistant of claim 3 wherein said grasping portion extends in an opposite direction to a direction defined from said second higher end to said leading lower end of said generally wedge-shaped wedge portion, when said door assistant is manipulated for use.

7. The door assistant of claim 3 wherein said downward sloping surface of said wedged-shaped foot pad extends from said first higher end to said second trailing lower end of said wedge-shaped foot pad, and wherein the height of said first higher end of said wedge-shaped foot pad is approximately equal to the height of said second higher end of said generally wedge-shaped wedge portion.

8. The door assistant of claim 7 wherein said wedged-shaped foot pad is of greater width than the width of said generally wedge-shaped wedge portion.

9. The door assistant of claim 1 wherein said wedge-shaped wedge portion and said wedge-shaped foot pad are hingedly connected to said central base block in a hinged arrangement of said wedge-shaped wedge portion and said wedge-shaped foot pad adapted to substantially align said wedge-shaped wedge portion and said wedge-shaped foot pad with said vertically extending portion of said handle for packaging and transport of said door assistant.

10. The door assistant of claim 1 wherein a lower end of said generally vertically extending portion of said handle is located in a socket in said central base block.

11. The door assistant of claim 1 wherein:

said generally wedge-shaped wedge portion is hingedly connected to said central base block at said second higher end of said generally wedge-shaped wedge portion, and said wedge-shaped foot pad is hingedly connected to said central base block at said first higher end of said wedge-shaped foot pad.

12. The door assistant of claim 1 wherein said handle extends upwardly from said central base block.

13. The door assistant of claim 1 wherein said handle is connected to said central base block.

14. The door assistant of claim 1 wherein said generally vertically extending portion of said handle includes a vertical element extending upwardly from said central base block.

15. The door assistant of claim 1 wherein said grasping portion of said handle is rotatably mounted to said vertically extending portion of said handle by a release mechanism and wherein said release mechanism operated by a pushbutton.

16. The door assistant of claim 15 wherein said pushbutton is located in said grasping portion.

17. The door assistant of claim 1 wherein:

said generally vertically extending portion of said handle includes a vertical tubular element extending upwardly from said central base block;

said grasping portion of said handle includes (i) a shaft portion coaxial with the vertical tubular element and (ii) a grip portion extending substantially normal to the axis of the shaft portion; and said shaft portion is rotatably mounted to said vertical tubular element.

* * * * *